US006679322B1

(12) United States Patent
Zupanick

(10) Patent No.: US 6,679,322 B1
(45) **Date of Patent: *Jan. 20, 2004**

(54) METHOD AND SYSTEM FOR ACCESSING SUBTERRANEAN DEPOSITS FROM THE SURFACE

(75) Inventor: Joseph A. Zupanick, Pineville, WV (US)

(73) Assignee: CDX Gas, LLC, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/256,412

(22) Filed: Sep. 26, 2002

Related U.S. Application Data

(63) Continuation of application No. 09/885,219, filed on Jun. 20, 2001, now Pat. No. 6,561,288, which is a continuation of application No. 09/444,029, filed on Nov. 19, 1999, now Pat. No. 6,357,523, which is a continuation-in-part of application No. 09/197,687, filed on Nov. 20, 1998, now Pat. No. 6,280,000.

(51) Int. Cl.[7] ..... E21B 43/00
(52) U.S. Cl. ..... 166/50; 166/313; 166/52
(58) Field of Search ..... 166/50, 52, 245, 166/263, 313; 175/69

(56) References Cited

U.S. PATENT DOCUMENTS

| | | | | |
|---|---|---|---|---|
| 54,144 | A | 4/1866 | Hamar | |
| 274,740 | A | 3/1883 | Douglass | |
| 526,708 | A | 10/1894 | Horton | |
| 639,036 | A | 12/1899 | Heald | |
| 1,189,560 | A | 7/1916 | Gondos | |
| 1,285,347 | A | 11/1918 | Otto | |
| 1,467,480 | A | 9/1923 | Hogue | |
| 1,485,615 | A | 3/1924 | Jones | |
| 1,674,392 | A | 6/1928 | Flansburg | |
| 1,777,961 | A | 10/1930 | Capeliuschnicoff | |
| 2,018,285 | A | 10/1935 | Schweitzer et al. | 166/21 |
| 2,069,482 | A | 2/1937 | Seay | 255/76 |
| 2,150,228 | A | 3/1939 | Lamb | 166/10 |
| 2,169,718 | A | 8/1939 | Böll et al. | 255/24 |
| 2,335,085 | A | 11/1943 | Roberts | 251/107 |
| 2,450,223 | A | 9/1948 | Barbour | 255/76 |
| 2,490,350 | A | 12/1949 | Grable | 166/4 |
| 2,679,903 | A | 6/1954 | McGowen, Jr. et al. | 166/1 |
| 2,726,063 | A | 12/1955 | Ragland et al. | 255/1.8 |

(List continued on next page.)

FOREIGN PATENT DOCUMENTS

| | | | |
|---|---|---|---|
| DE | 197 25 996 A1 | 1/1998 | E03B/3/10 |
| EP | 0 819 834 A1 | 1/1998 | E21B/43/28 |
| EP | 0 875 661 A | 11/1998 | E21B/43/30 |
| EP | 0 952 300 A1 | 10/1999 | E21B/7/12 |
| FR | 964503 | 4/1944 | 8/1 |
| GB | 2 347 157 A | 8/2000 | E21B/43/00 |
| WO | 94/21889 | 9/1994 | E21B/43/24 |
| WO | WO 99/60248 | 11/1999 | E21B/43/30 |
| WO | WO 00/79099 | 12/2000 | E21B/43/25 |
| WO | WO 02/059455 | 8/2002 | E21B/43/00 |

OTHER PUBLICATIONS

Joseph A. Zupanick; Declaration of Experimental Use with attached exhibits A–D, pp. 1–3, Nov. 14, 2000.

(List continued on next page.)

*Primary Examiner*—Heather Shackelford
*Assistant Examiner*—John Kreck
(74) *Attorney, Agent, or Firm*—Baker Botts, L.L.P.

(57) ABSTRACT

Improved method and system for accessing subterranean deposits from the surface that substantially eliminates or reduces the disadvantages and problems associated with previous systems and methods. In particular, the present invention provides an articulated well with a drainage pattern that intersects a horizontal cavity well. The drainage patterns provide access to a large subterranean area from the surface while the vertical cavity well allows entrained water, hydrocarbons, and other deposits to be efficiently removed and/or produced.

3 Claims, 7 Drawing Sheets

U.S. PATENT DOCUMENTS

| | | | | |
|---|---|---|---|---|
| 2,726,847 | A | 12/1955 | McCune et al. | 255/1.6 |
| 2,783,018 | A | 2/1957 | Lytle | 251/25 |
| 2,847,189 | A | 8/1958 | Shook | 255/76 |
| 2,911,008 | A | 11/1959 | Du Bois | 137/625.31 |
| 2,980,142 | A | 4/1961 | Turak | 137/637.3 |
| 3,347,595 | A | 10/1967 | Dahms et al. | 299/4 |
| 3,443,648 | A | 5/1969 | Howard | 175/103 |
| 3,473,571 | A | 10/1969 | Dugay | 137/625.4 |
| 3,503,377 | A | 3/1970 | Beatenbough et al. | 123/117 |
| 3,528,516 | A | 9/1970 | Brown | 175/267 |
| 3,530,675 | A | 9/1970 | Turzillo | 61/35 |
| 3,684,041 | A | 8/1972 | Kammerer, Jr. et al. | 175/267 |
| 3,692,041 | A | 9/1972 | Bondi | 137/238 |
| 3,757,876 | A | 9/1973 | Pereau | 175/267 |
| 3,757,877 | A | 9/1973 | Leathers | 175/269 |
| 3,800,830 | A | 4/1974 | Etter | 137/625.41 |
| 3,809,519 | A | 5/1974 | Garner | 425/245 |
| 3,825,081 | A | 7/1974 | McMahon | 175/73 |
| 3,828,867 | A | 8/1974 | Elwood | 175/45 |
| 3,874,413 | A | 4/1975 | Valdez | 137/625.47 |
| 3,887,008 | A | 6/1975 | Canfield | 166/267 |
| 3,902,322 | A | 9/1975 | Watanabe | 61/35 |
| 3,934,649 | A | 1/1976 | Pasini, III et al. | 166/254 |
| 3,957,082 | A | 5/1976 | Fuson et al. | 137/625.41 |
| 3,961,824 | A | 6/1976 | Van Eek et al. | 299/17 |
| 4,011,890 | A | 3/1977 | Andersson | 137/625.4 |
| 4,022,279 | A | 5/1977 | Driver | 166/271 |
| 4,037,658 | A | 7/1977 | Anderson | 166/272 |
| 4,073,351 | A | 2/1978 | Baum | 175/14 |
| 4,089,374 | A | 5/1978 | Terry | 166/259 |
| 4,116,012 | A | 9/1978 | Abe et al. | 405/238 |
| 4,156,437 | A | 5/1979 | Chivens et al. | 137/554 |
| 4,169,510 | A | 10/1979 | Meigs | 175/65 |
| 4,189,184 | A | 2/1980 | Green | 299/8 |
| 4,220,203 | A | 9/1980 | Steeman | 166/271 |
| 4,221,433 | A | 9/1980 | Jacoby | 299/4 |
| 4,257,650 | A | 3/1981 | Allen | 299/2 |
| 4,278,137 | A | 7/1981 | Van Eek | 175/267 |
| 4,283,088 | A | 8/1981 | Tabakov et al. | 299/2 |
| 4,296,785 | A | 10/1981 | Vitello et al. | 141/106 |
| 4,299,295 | A | 11/1981 | Gossard | 175/45 |
| 4,303,127 | A | 12/1981 | Freel et al. | 166/266 |
| 4,305,464 | A | 12/1981 | Masszi | 166/370 |
| 4,312,377 | A | 1/1982 | Knecht | 137/625.19 |
| 4,317,492 | A | 3/1982 | Summers et al. | 175/79 |
| 4,328,577 | A | 5/1982 | Abbott et al. | 370/84 |
| 4,366,988 | A | 1/1983 | Bodine | 299/14 |
| 4,372,398 | A | 2/1983 | Kuckes | 175/45 |
| 4,386,665 | A | 6/1983 | Dellinger | 175/61 |
| 4,390,067 | A | 6/1983 | Willman | 166/245 |
| 4,396,076 | A | 8/1983 | Inoue | 175/265 |
| 4,397,360 | A | 8/1983 | Schmidt | 175/61 |
| 4,401,171 | A | 8/1983 | Fuchs | 175/267 |
| 4,407,376 | A | 10/1983 | Inoue | 175/267 |
| 4,442,896 | A | 4/1984 | Reale et al. | 166/278 |
| 4,494,616 | A | 1/1985 | McKee | 175/67 |
| 4,512,422 | A | 4/1985 | Knisley | 175/99 |
| 4,519,463 | A | 5/1985 | Schuh | 175/61 |
| 4,527,639 | A | 7/1985 | Dickinson, III et al. | 175/61 |
| 4,532,986 | A | 8/1985 | Mims et al. | 166/50 |
| 4,544,037 | A | 10/1985 | Terry | 166/369 |
| 4,558,744 | A | 12/1985 | Gibb | 166/335 |
| 4,565,252 | A | 1/1986 | Campbell et al. | 175/269 |
| 4,573,541 | A | 3/1986 | Josse et al. | 175/78 |
| 4,599,172 | A | 7/1986 | Gardes | 210/314 |
| 4,600,061 | A | 7/1986 | Richards | 175/62 |
| 4,605,076 | A | 8/1986 | Goodhart | 175/61 |
| 4,611,855 | A | 9/1986 | Richards | 299/2 |
| 4,618,009 | A | 10/1986 | Carter et al. | 175/267 |
| 4,638,949 | A | 1/1987 | Mancel | 239/307 |
| 4,646,836 | A | 3/1987 | Goodhart | 166/303 |
| 4,674,579 | A | 6/1987 | Geller et al. | 175/46 |
| 4,702,314 | A | 10/1987 | Huang et al. | 166/245 |
| 4,705,431 | A | 11/1987 | Gadelle et al. | 405/267 |
| 4,715,440 | A | 12/1987 | Boxell et al. | 166/100 |
| 4,754,819 | A | 7/1988 | Dellinger | 175/61 |
| 4,756,367 | A | 7/1988 | Puri et al. | 166/263 |
| 4,763,734 | A | 8/1988 | Dickinson et al. | 175/61 |
| 4,773,488 | A | 9/1988 | Bell et al. | 175/61 |
| 4,830,105 | A | 5/1989 | Petermann | 166/241 |
| 4,836,611 | A | 6/1989 | El-Saie | 299/7 |
| 4,842,081 | A | 6/1989 | Parant | 175/23 |
| 4,844,182 | A | 7/1989 | Tolle | 175/215 |
| 4,852,666 | A | 8/1989 | Brunet et al. | 175/61 |
| 4,883,122 | A | 11/1989 | Puri et al. | 166/263 |
| 4,978,172 | A | 12/1990 | Schwoebel et al. | 299/12 |
| 5,035,605 | A | 7/1991 | Dinerman et al. | 425/564 |
| 5,036,921 | A | 8/1991 | Pittard et al. | 166/298 |
| 5,074,360 | A | 12/1991 | Guinn | 166/281 |
| 5,074,365 | A | 12/1991 | Kuckes | 175/40 |
| 5,074,366 | A | 12/1991 | Karlsson et al. | 175/76 |
| 5,082,054 | A | 1/1992 | Kiamanesh | 166/248 |
| 5,106,710 | A | 4/1992 | Wang et al. | 166/245 |
| 5,111,893 | A | 5/1992 | Kvello-Aune | 175/258 |
| 5,121,244 | A | 6/1992 | Takasaki | 359/161 |
| 5,135,058 | A | 8/1992 | Millgard et al. | 175/71 |
| 5,148,875 | A | 9/1992 | Karlsson et al. | 175/62 |
| 5,165,491 | A | 11/1992 | Wilson | 175/62 |
| 5,168,942 | A | 12/1992 | Wydrinski | 175/50 |
| 5,174,374 | A | 12/1992 | Hailey | 166/55.8 |
| 5,193,620 | A | 3/1993 | Braddick | 166/382 |
| 5,194,859 | A | 3/1993 | Warren | 340/853.4 |
| 5,194,977 | A | 3/1993 | Nishio | 359/128 |
| 5,197,553 | A | 3/1993 | Leturno | 175/57 |
| 5,197,783 | A | 3/1993 | Theimer et al. | 299/17 |
| 5,199,496 | A | 4/1993 | Redus et al. | 166/366 |
| 5,201,817 | A | 4/1993 | Hailey | 175/269 |
| 5,217,076 | A | 6/1993 | Masek | 166/303 |
| 5,240,350 | A | 8/1993 | Yamaguchi et al. | 405/143 |
| 5,242,017 | A | 9/1993 | Hailey | 166/55.8 |
| 5,246,273 | A | 9/1993 | Rosar | 299/4 |
| 5,255,741 | A | 10/1993 | Alexander | 166/278 |
| 5,271,472 | A | 12/1993 | Leturno | 175/107 |
| 5,301,760 | A | 4/1994 | Graham | 175/61 |
| 5,363,927 | A | 11/1994 | Frank | 175/67 |
| 5,385,205 | A | 1/1995 | Hailey | 166/55.8 |
| 5,394,950 | A | 3/1995 | Gardes | 175/45 |
| 5,402,851 | A | 4/1995 | Baiton | 166/369 |
| 5,411,082 | A | 5/1995 | Kennedy | 166/181 |
| 5,411,085 | A | 5/1995 | Moore et al. | 166/242 |
| 5,411,104 | A | 5/1995 | Stanley | 175/65 |
| 5,411,105 | A | 5/1995 | Gray | 175/69 |
| 5,431,220 | A | 7/1995 | Lennon et al. | 166/55.7 |
| 5,435,400 | A | 7/1995 | Smith | 175/61 |
| 5,447,416 | A | 9/1995 | Wittrisch | 417/442 |
| 5,450,902 | A | 9/1995 | Matthews | 166/268 |
| 5,454,419 | A | 10/1995 | Vloedman | 166/277 |
| 5,458,209 | A | 10/1995 | Hayes et al. | 175/61 |
| 5,462,116 | A | 10/1995 | Carroll | 166/249 |
| 5,462,120 | A | 10/1995 | Gondouin | 166/380 |
| 5,469,155 | A | 11/1995 | Archambeault et al. | 340/853.4 |
| 5,477,923 | A | 12/1995 | Jordan, Jr. et al. | 166/313 |
| 5,485,089 | A | 1/1996 | Kuckes | 324/346 |
| 5,494,121 | A | 2/1996 | Nackerud | 175/263 |
| 5,501,273 | A | 3/1996 | Puri | 166/252.5 |
| 5,501,279 | A | 3/1996 | Garg et al. | 166/372 |
| 5,584,605 | A | 12/1996 | Beard et al. | 405/128 |
| 5,613,242 | A | 3/1997 | Oddo | 588/17 |
| 5,615,739 | A | 4/1997 | Dallas | 166/306 |
| 5,659,347 | A | 8/1997 | Taylor | 347/85 |
| 5,669,444 | A | 9/1997 | Riese et al. | 166/263 |

| | | | | |
|---|---|---|---|---|
| 5,680,901 | A | 10/1997 | Gardes | 166/313 |
| 5,690,390 | A | 11/1997 | Bithell | 299/4 |
| 5,706,871 | A | 1/1998 | Andersson et al. | 141/59 |
| 5,720,356 | A | 2/1998 | Gardes | 175/62 |
| 5,727,629 | A | 3/1998 | Blizzard, Jr. et al. | 166/298 |
| 5,735,350 | A | 4/1998 | Longbottom et al. | 166/313 |
| 5,771,976 | A | 6/1998 | Talley | 166/370 |
| 5,785,133 | A | 7/1998 | Murray et al. | 175/61 |
| 5,832,958 | A | 11/1998 | Cheng | 137/625.41 |
| 5,852,505 | A | 12/1998 | Li | 359/118 |
| 5,853,054 | A | 12/1998 | McGarian et al. | 175/267 |
| 5,853,056 | A | 12/1998 | Landers | 175/424 |
| 5,863,283 | A | 1/1999 | Gardes | 588/250 |
| 5,867,289 | A | 2/1999 | Gerstel et al. | 359/110 |
| 5,868,202 | A | 2/1999 | Hsu | 166/256 |
| 5,868,210 | A | 2/1999 | Johnson et al. | 175/40 |
| 5,879,057 | A | 3/1999 | Schwoebel et al. | 299/17 |
| 5,884,704 | A | 3/1999 | Longbottom et al. | 16/313 |
| 5,912,754 | A | 6/1999 | Koga et al. | 359/179 |
| 5,914,798 | A | 6/1999 | Liu | 359/161 |
| 5,917,325 | A | 6/1999 | Smith | 324/326 |
| 5,934,390 | A | 8/1999 | Uthe | 175/67 |
| 5,957,539 | A | 9/1999 | Durup et al. | 299/4 |
| 6,012,520 | A | 1/2000 | Yu et al. | 196/245 |
| 6,024,171 | A | 2/2000 | Montgomery et al. | 166/308 |
| 6,050,335 | A | 4/2000 | Parsons | 166/272.3 |
| 6,056,059 | A | 5/2000 | Ohmer | 166/313 |
| 6,065,550 | A | 5/2000 | Gardes | 175/62 |
| 6,119,771 | A | 9/2000 | Gano et al. | 166/50 |
| 6,135,208 | A | 10/2000 | Gano et al. | 166/313 |
| 6,280,000 | B1 | 8/2001 | Zupanick | 299/12 |
| 6,349,769 | B1 | 2/2002 | Ohmer | 166/313 |
| 6,357,523 | B1 | 3/2002 | Zupanick | 166/52 |
| 6,425,448 | B1 | 7/2002 | Zupanick et al. | 175/61 |
| 6,439,320 | B2 | 8/2002 | Zupanick | 175/61 |
| 6,450,256 | B2 | 9/2002 | Mones | 166/250.01 |
| 6,457,540 | B2 | 10/2002 | Gardes | 175/62 |

OTHER PUBLICATIONS

Howard L. Hartman, et al.; "*SME Mining Engineering Handbook*;" Society for Mining, Metallurgy, and Exploration, Inc. pp. 1946–1950, 2nd Edition, vol. 2, 1992.

Abstract of AU 8549964, Derwent Information Ltd., pp. 1–2, 1987.

Robert W. Taylor and Richard Russell, Multilateral Technologies Increase Operational Efficiencies in Middle East, Oil & Gas Journal, pp. 76–80, Mar. 16, 1998.

Adam Pasiczynk, "Evolution Simplifies Multilateral Wells", Directional Drilling, pp. 53–55, Jun. 2000.

Steven S. Bell, "Multilateral System with Full Re–Entry Access Installed", World Oil, p. 29, Jun. 1996.

P. Jackson and S. Kershaw, Reducing Long Term Methane Emissions Resulting from Coal Mining, Energy Convers. Mgmt, vol. 37, Nos. 6–8, pp. 801–806, 1996.

Pascal Breant, "Des Puits Branches, Chez Total : les puits multi drains", Total Exploration Production, pp. 1–5, Jan. 1999.

Susan Eaton, "Reveral of Fortune", New Technology Magazine, pp 30–31, Sep. 2002.

James Mahony, "A Shadow of Things to Come", New Technology Magazine, pp. 28–29, Sep. 2002.

Documents Received from Third Party, Great Lakes Directional Drilling, Inc., (12 pages).

U.S. Patent Application Publication No. US 2002/0096336 "Method and System for Surface Production of Gas from a Subterranean Zone" Ser. No. 10/003,917 (0161), Nov. 1, 2001.

U.S. Patent Application Publication No. US 2002/0108746 A1 "Method and System for Accessing Subterranean Zones from a Limited Surface Area" Ser. No. 10/123,561 (0193), Apr. 5, 2002.

U.S. Patent Application Publication No. US 2002/0148613 "Method and System for Accessing Subterranean Deposits from the Surface" Ser. No. 10/165,626 (0185), Jun. 7, 2002.

U.S. Patent Application Publication No. US 2002/0148605 "Method and System for Accessing Subterranean Deposits from the Surface" Ser. No. 10,165,625 (0184), Jun. 7, 2002.

U.S. Pending patent application Ser. No. 10/188,141, entitled "Method and System for Accessing a Subterranean Zone from a Limited Surface Area," Joseph A. Zupanick et al., filed Jul. 1, 2002, (067083.0201).

U.S. Pending patent application Ser. No. 10/046,001, entitled "Method and System for Management of By–Products From Subterranean Zones," Joseph A. Zupanick, filed Oct. 19, 2001. 42 pages. (067083.0134).

U.S. patent application Ser. No. 10/004,316, entitled "Slant Entry Well System and Method," Joseph A. Zupanick, filed Oct. 30, 2001, 35 pages. (067083.0162).

U.S. Pending patent application Ser. No. 10/142,817, entitled "Method and System for Underground Treatment of Materials," Joseph A. Zupanick, filed May 8, 2002, 54 pgs. (067083.0119) May 2, 2002.

U.S. Pending patent application Ser. No. 10/194,366, entitled "Undulating Well Bore," filed Jul. 12, 2002, Joseph A. Zupanick, filed Jul. 12, 2002 (067083.0176).

U.S. Pending patent application Ser. No. 10/194,367, entitled "Ramping Well Bores," Joseph A. Zupanick, filed Jul. 12, 2002 (067083.01279).

U.S. Pending patent application Ser. No. 10/194,368, entitled "Wellbore Sealing System and Method," Joseph A. Zupanick, filed Jul. 12, 2002 (067083.0188) Jul. 12, 2002.

U.S. Pending patent application Ser. No. 10/194,422, entitled "Wellbore Plug System and Method," Joseph A. Zupanick, filed Jul. 12, 2002 (067083.0189).

U.S. Pending patent application Ser. No. 10/227,057, entitled "System and Method for Subterranean Access," Joseph A. Zupanick, filed Aug. 22, 2002 (067083.0181).

U.S. Pending patent application Ser. No. 10/244,082, entitled, "Method and System for Controlling Pressure in a Dual Well System," Joseph A. Zupanick, filed Sep. 12, 2002 (067083.0187).

U.S. Pending patent application Ser. No. 10/244,083, entitled "Three–Dimensional Well System for Accessing Subterranean Zones," Joseph A. Zupanick, filed Sep. 12, 2002 (067073.0190).

U.S. Pending patent application Ser. No. 10/246,052, entitled "Accelerated Production of Gas From a Subterranean Zone," filed Sep. 17, 2002 (067083.0175).

U.S. Pending patent application Ser. No. 10/264,535, entitled "Method and System for Removing Fluid From a Subterranean Zone Using an Enlarged Cavity," Joseph A. Zupanick, filed Oct. 3, 2002 (067083.0197).

U.S. Pending patent application Ser. No. 10/267,426, entitled "Method of Drilling Lateral Wellbores From a Slant Wall Without Utilizing a Whipstock," Joseph A. Zupanick, filed Oct. 8, 2002 (0670830.0192).

U.S. Pending patent application Ser. No. 10/323,192, entitled "Method and System for Circulating Fluid in a Well," Joseph A. Zupanick, filed Dec. 18, 2002 (067083.0195).

Dave Hassan, Mike Chernichen, Earl Jensen, and Morley Frank; "*Multi–lateral technique lowers drilling costs, provides environemntal benefits*", Drilling Technology, pp. 41–47, Oct. 1999.

McCray and Cole, "*Oil Well Drilling and Technology*," University of Oklahoma Press, pp 315–319, 1959.

Berger and Anderson, "*Modern Petroleum*;" Penn Well Books, pp 106–108, 1978.

Rudy E. Rogers, "*Coalbed Methane: Principles & Practice*," Prentice Hall Petroleum Enginering Series, 1994.

Pend Pat App, Joseph A. Zumanick "*Method and System for Enhanced Access to a Subterranean Zone*", Ser. No. 09/769,098 (067083.0118), filed Jan. 24, 2001.

Pend Pat App, Joseph A. Zupanick et al., "*Method and System for Accessing a Subterranean Zone From a Limited Surface Area*," Ser. No. 09/774,996 (067083.0120), filed Jan. 30, 2001.

Weiguo Chi & Luwu Yang, "*Feasibility of Coalbed Methane Exploitation in China*," Horizontal Well Technology, p. 74, Sep. 2001.

Gopal Ramaswamu, "*Production History Provides CBM Insights*," Oil & Gas Journal pp. 49, 50 &52, Apr. 2, 2001.

Nackerud Product Description.

Pending Patent Application, Joseph A. Zupanick, "*Method and System for Accessing Subterranean Depostis From The Surface*," Ser. No. 09/789,956, filed Feb. 20, 1999.

Pending Patent Application, Joseph A. Zupanick, "*Method and System for Accessing Subterranean Deposits From The Surface*," Ser. No. 09/788,897, filed Feb. 20, 2001.

Gopal Ramaswamy, "*Advances Key For Coalbed Methane*" The American Oil & Gas Reporter, pp. 71 &73, Oct. 2001.

Arfon H. Jones et al., "A Review of the Physical and Mechanical Properties of Coal with Implications for Coal-Bed Methane Well Completion and Production", *Rocky Mountain Association of Geologists*, pp 169–181, 1988.

Joseph C. Stevens, Horizontal Applications for Coal Bed Methane Revcovery, 3rd Annual Coalbed and Coal Mine Conference, *Strategic Research Institute*, pp. 1–10 slides, Mar. 25, 2002.

R.J. "Bob" Stayton, "Horizontal Wells Boost CBM Recovery", Special Report: Horizontal & Directional Drilling, *The American Oil & Gas Reporter*, pp. 71–75, Aug. 2002.

Kelley et al., U.S. Patent Application publication, Pub. No. US 2002/0074122 A1, Method and Apparatus for Hydrocarbon Subterranean Recovery, Jun. 20, 2002.

METHOD AND SYSTEM FOR ACCESSING SUBTERRANEAN DEPOSITS FROM THE SURFACE

RELATED APPLICATIONS

This application is a continuation of U.S. application Ser. No. 09/885,219, filed Jun. 20, 2001 by Joseph A. Zupanick and entitled "Method and System for Accessing Subterranean Deposits from the Surface" now U.S. Pat. No. 6,561,288, which is a continuation of U.S. application Ser. No. 09/444,029 filed Nov. 19, 1999 by Joseph A. Zupanick and entitled "Drainage Pattern with Intersecting Wells Drilled from Surface" now U.S. Pat. No. 6,357,523, which is a continuation-in-part of U.S. application Ser. No. 09/197,687 filed Nov. 20, 1998 by Joseph A. Zupanick and entitled "Method for Production of Gas From a Coal Seam" now U.S. Pat. No. 6,280,000.

TECHNICAL FIELD OF THE INVENTION

The present invention relates generally to the recovery of subterranean deposits, and more particularly to a method and system for accessing subterranean deposits from the surface.

BACKGROUND OF THE INVENTION

Subterranean deposits of coal contain substantial quantities of entrained methane gas limited in production in use of methane gas from coal deposits has occurred for many years. Substantial obstacles, however, have frustrated more extensive development and use of methane gas deposits in coal seams. The foremost problem in producing methane gas from coal seams is that while coal seams may extend over large areas of up to several thousand acres, the coal seams are fairly shallow in depth, varying from a few inches to several meters. Thus, while the coal seams are often relatively near the surface, vertical wells drilled into the coal deposits for obtaining methane gas can only drain a fairly small radius around the coal deposits. Further, coal deposits are not amendable to pressure fracturing and other methods often used for increasing methane gas production from rock formations. As a result, once the gas easily drained from a vertical well bore in a coal seam is produced, further production is limited in volume. Additionally, coal seams are often associated with subterranean water, which must be drained from the coal seam in order to produce the methane.

Horizontal drilling patterns have been tried in order to extend the amount of coal seams exposed to a drill bore for gas extraction. Such horizontal drilling techniques, however, require the use of a radiused well bore which presents difficulties in removing the entrained water from the coal seam. The most efficient method for pumping water from a subterranean well, a sucker rod pump, does not work well in horizontal or radiused bores.

A further problem for surface production of gas from coal seams is the difficulty presented by under balanced drilling conditions caused by the porousness of the coal seam. During both vertical and horizontal surface drilling operations, drilling fluid is used to remove cuttings from the well bore to the surface. The drilling fluid exerts a hydrostatic pressure on the formation which, if it exceeds the hydrostatic pressure of the formation, can result in a loss of drilling fluid into the formation. This results in entrainment of drilling finds in the formation, which tends to plug the pores, cracks, and fractures that are needed to produce the gas.

As a result of these difficulties in surface production of methane gas from coal deposits, the methane gas which must be removed from a coal seam prior to mining, has been removed from coal seams through the use of subterranean methods. While the use of subterranean methods allows water to be easily removed from a coal seam and eliminates under balanced drilling conditions, they can only access a limited amount of the coal seams exposed by current mining operations. Where longwall mining is practiced, for example, underground drilling rigs are used to drill horizontal holes from a panel currently being mined into an adjacent panel that will later be mined. The limitations of underground rigs limits the reach of such horizontal holes and thus the area that can be effectively drained. In addition, the degasification of a next panel during mining of a current panel limits the time for degasification. As a result, many horizontal bores must be drilled to remove the gas in a limited period of time. Furthermore, in conditions of high gas content or migration of gas through a coal seam, mining may need to be halted or delayed until a next panel can be adequately degasified. These production delays add to the expense associated with degasifying a coal seam.

SUMMARY OF THE INVENTION

The present invention provides an improved method and system for accessing subterranean deposits from the surface that substantially eliminates or reduces the disadvantages and problems associated with previous systems and methods. In particular, the present invention provides an articulated well with a drainage pattern that intersects a horizontal cavity well. The drainage patterns provide access to a large subterranean area from the surface while the vertical cavity well allows entrained water, hydrocarbons, and other deposits to be efficiently removed and/or produced.

In accordance with one embodiment of the present invention, a method for accessing a subterranean zone from the surface includes drilling a substantially vertical well bore from the surface to the subterranean zone. An articulated well bore is drilled from the surface to the subterranean zone. The articulated well bore is horizontally offset from the substantially vertical well bore at the surface and intersects the substantially vertical well bore at a junction proximate to the subterranean zone. A substantially horizontal drainage pattern is drilled through the articulated well bore from the junction into the subterranean zone.

In accordance with another aspect of the present invention, the substantially horizontal drainage pattern may comprise a pinnate pattern including a substantially horizontal diagonal well bore extending from the substantially vertical well bore that defines a first end of an area covered by the drainage pattern to a distant end of the area. A first of substantially horizontal lateral well bores extend in space relation to each other from the diagonal well bore to the periphery of the area on a first side of the diagonal well bore. A second set of substantially horizontal lateral well bores extend in space relation to each other from the diagonal well bore to the periphery of the area on a second, opposite side of the diagonal.

In accordance with still another aspect of the present invention, a method for preparing a subterranean zone for mining uses the substantially vertical and articulated well bores and the drainage pattern. Water is drained from the subterranean zone through the drainage pattern to the junction of the substantially vertical well bore. Water is pumped from the junction to the surface through the substantially vertical well bore. Gas is produced from the subterranean zone through at least one of the substantially vertical and articulated well bores. After degasification has been completed, the subterranean zone may be further prepared by pumping water and other additives into the zone through the drainage pattern.

In accordance with yet another aspect of the present invention, a pump positioning device is provided to accurately position a downhole pump in a cavity of a well bore.

Technical advantages of the present invention include providing an improved method and system for accessing subterranean deposits from the surface. In particular, a horizontal drainage pattern is drilled in a target zone from an articulated surface well to provide access to the zone from the surface. The drainage pattern intersected by a vertical cavity well from which entrained water, hydrocarbons, and other fluids drained from the zone can be efficiently removed and/or produced by a rod pumping unit. As a result, gas, oil, and other fluids can be efficiently produced at the surface from a low pressure or low porosity formation.

Another technical advantage of the present invention includes providing an improved method and system for drilling into low-pressure reservoirs. In particular, a downhole pump or gas lift is used to lighten hydrostatic pressure exerted by drilling fluids used to remove cuttings during drilling operations. As a result, reservoirs may be drilled at ultra-low pressures without loss of drilling fluids into the formation and plugging of the formation.

Yet another technical advantage of the present invention includes providing an improved horizontal drainage pattern for accessing a subterranean zone. In particular, a pinnate structure with a main diagonal and opposed laterals is used to maximize access to a subterranean zone from a single vertical well bore. Length of the laterals is maximized proximate to the vertical well bore and decreased toward the end of the main diagonal to provide uniform access to a quadrilateral or other grid area. This allows the drainage pattern to be aligned with longwall panels and other subsurface structures for degasification of a mine coal seam or other deposit.

Still another technical advantage of the present invention includes providing an improved method and system for preparing a coal seam or other subterranean deposit for mining. In particular, surface wells are used to degasify a coal seam ahead of mining operations. This reduces underground equipment and activities and increases the time provided to degasify the seam which minimizes shutdowns due to high gas content. In addition, water and additives may be pumped into the degasified coal seam prior to mining operations to minimize dust and other hazardous conditions, to improve efficiency of the mining process, and to improve the quality of the coal product.

Still another technical advantage of the present invention includes providing an improved method and system for producing methane gas from a mined coal seam. In particular, well bores used to initially degasify a coal seam prior to mining operations may be reused to collect gob gas from the seam after mining operation. As a result, costs associated with the collection of gob gas are minimized to facilitate or make feasible the collection of gob gas from previously mined seams.

Still another technical advantage of the present invention includes providing a positioning device for automatically positioning down-hole pumps and other equipment in a cavity. In particular, a rotatable cavity positioning device is configured to retract for transport in a well bore and to extend within a down-hole cavity to optimally position the equipment within the cavity. This allows down-hole equipment to be easily positioned and secured within the cavity.

Other technical advantages of the present invention will be readily apparent to one skilled in the art from the following figures, description, and claims.

BRIEF DESCRIPTION OF THE DRAWINGS

For a more complete understanding of the present invention and its advantages, reference is now made to the following description taken in conjunction with the accompanying drawings, wherein like numerals represent like parts, in which.

DETAILED DESCRIPTION OF THE INVENTION

Figure 1:
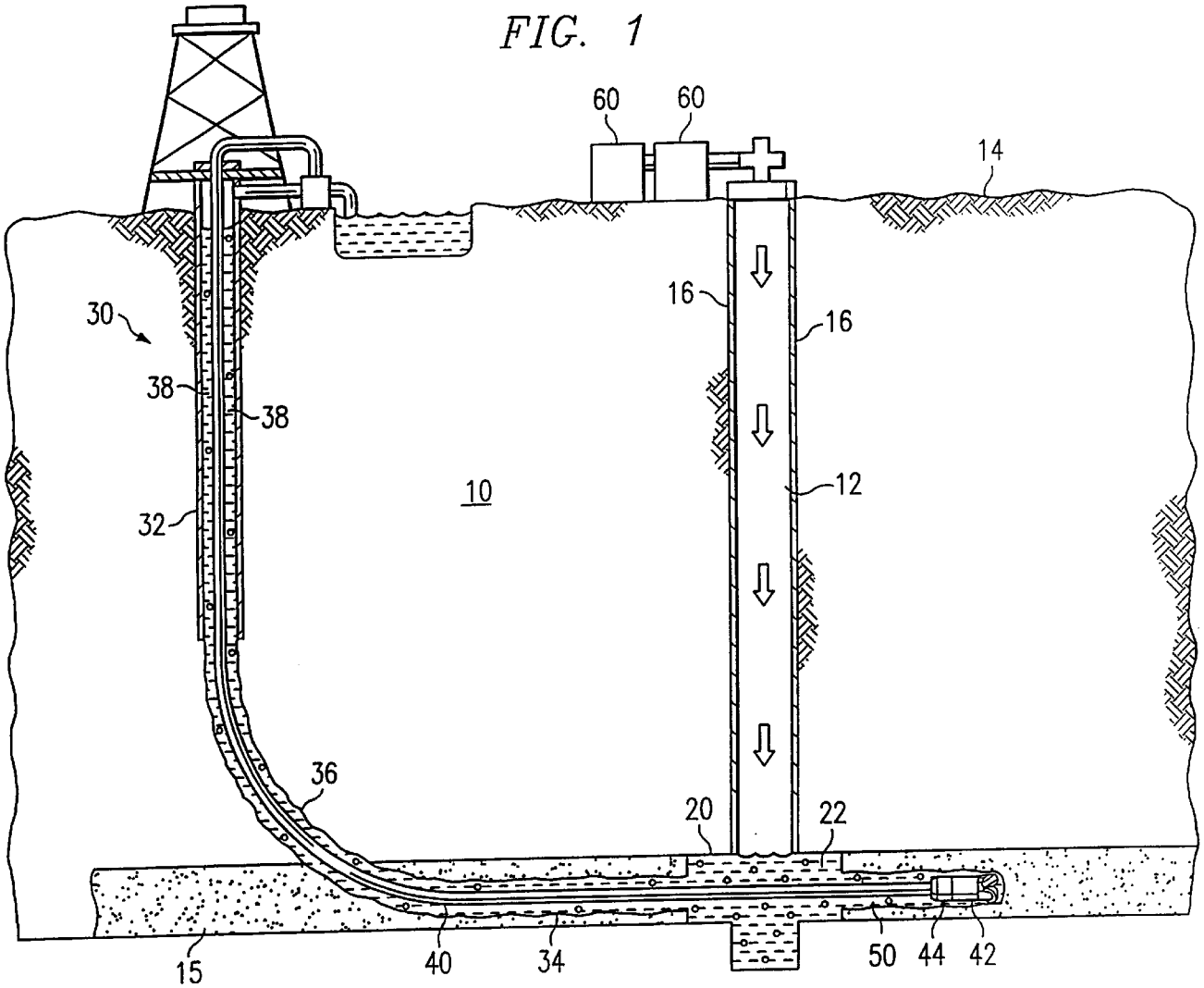
FIG. 1 is a cross-sectional diagram illustrating formation of a horizontal drainage pattern in a subterranean zone through an articulated surface well intersecting a vertical cavity well in accordance with one embodiment of the present invention.

FIG. 1 illustrates a cavity and articulated well combination for accessing a subterranean zone from the surface in accordance with one embodiment of the present invention. In this embodiment, the subterranean zone is a coal seam. It will be understood that other low pressure, ultra-low pressure, and low porosity subterranean zones can be similarly accessed using the dual well system of the present invention to remove and/or produce water, hydrocarbons and other fluids in the zone and to treat minerals in the zone prior to mining operations.

Referring to FIG. 1, a substantially vertical well bore 12 extends from the surface 14 to a target coal seam 15. The substantially vertical well bore 12 intersects, penetrates and continues below the coal seam 15. The substantially vertical well bore is lined with a suitable well casing 16 that terminates at or above the level of the coal seam 15.

The substantially vertical well bore 12 is logged either during or after drilling in order to locate the exact vertical depth of the coal seam 15. As a result, the coal seam is not missed in subsequent drilling operations and techniques used to locate the seam 15 while drilling need not be employed. An enlarged diameter cavity 20 is formed in the substantially vertical well bore 12 at the level of the coal seam 15. As described in more detail below, the enlarged diameter cavity 20 provides a junction for intersection of the substantially vertical well bore by articulated well bore used to form a substantially horizontal drainage pattern in the coal seam 15. The enlarged diameter cavity 20 also provides a collection point for fluids drained from the coal seam 15 during production operations.

In one embodiment, the enlarged diameter cavity 20 has a radius of approximately eight feet and a vertical dimension which equals or exceeds the vertical dimension of the coal seam 15. The enlarged diameter cavity 20 is formed using suitable under-reaming techniques and equipment. A vertical portion of the substantially vertical well bore 12 continues below the enlarged diameter cavity 20 to form a sump 22 for the cavity 20.

An articulated well bore 30 extends from the surface 14 to the enlarged diameter cavity 20 of the substantially vertical well bore 12. The articulated well bore includes a substantially vertical portion 32, a substantially horizontal portion 34, and a curved or radiused portion 36 interconnecting the vertical and horizontal portions 32 and 34. The horizontal portion 34 lies substantially in the horizontal plane of the coal seam 15 and intersects the large diameter cavity 20 of the substantially vertical well bore 12.

The articulated well bore 30 is offset a sufficient distance from the substantially vertical well bore 12 at the surface 14 to permit the large radius curved section 36 and any desired horizontal section 34 to be drilled before intersecting the enlarged diameter cavity 20. To provide the curved portion 36 with a radius of 100–150 feet, the articulated well bore 30 is offset a distance of about 300 feet from the substantially vertical well bore 12. This spacing minimizes the angle of the curved portion 36 to reduce friction in the bore 30 during drilling operations. As a result, reach of the articulated drill string drilled through the articulated well bore 30 is maximized.

The articulated well bore 30 is drilled using articulated drill string 40 that includes a suitable down-hole motor and bit 42. A measurement while drilling (MWD) device 44 is included in the articulated drill string 40 for controlling the orientation and direction of the well bore drilled by the motor and bit 42. The substantially vertical portion 32 of the articulated well bore 30 is lined with a suitable casing 38.

After the enlarged diameter cavity 20 has been successfully intersected by the articulated well bore 30, drilling is continued through the cavity 20 using the articulated drill string 40 and appropriate horizontal drilling apparatus to provide a substantially horizontal drainage pattern 50 in the coal seam 15. The substantially horizontal drainage pattern 50 and other such well bores include sloped, undulating, or other inclinations of the coal seam 15 or other subterranean zone. During this operation, gamma ray logging tools and conventional measurement while drilling devices may be employed to control and direct the orientation of the drill bit to retain the drainage pattern 50 within the confines of the coal seam 15 and to provide substantially uniform coverage of a desired area within the coal seam 15. Further information regarding the drainage pattern is described in more detail below in connection with FIGS. 4–7.

During the process of drilling the drainage pattern 50, drilling fluid or "mud" is pumped down the articulated drill string 40 and circulated out of the drill string 40 in the vicinity of the bit 42, where it is used to scour the formation and to remove formation cuttings. The cuttings are then entrained in the drilling fluid which circulates up through the annulus between the drill string 40 and the well bore walls until it reaches the surface 14, where the cuttings are removed from the drilling fluid and the fluid is then recirculated. This conventional drilling operation produces a standard column of drilling fluid having a vertical height equal to the depth of the well bore 30 and produces a hydrostatic pressure on the well bore corresponding to the well bore depth. Because coal seams tend to be porous and fractured, they may be unable to sustain such hydrostatic pressure, even if formation water is also present in the coal seam 15. Accordingly, if the full hydrostatic pressure is allowed to act on the coal seam 15, the result may be loss of drilling fluid and entrained cuttings into the formation. Such a circumstance is referred to as an "over balanced" drilling operation in which the hydrostatic fluid pressure in the well bore exceeds the ability of the formation to withstand the pressure. Loss of drilling fluids in cuttings into the formation not only is expensive in terms of the lost drilling fluids, which must be made up, but it tends to plug the pores in the coal seam 15, which are needed to drain the coal seam of gas and water.

To prevent over balance drilling conditions during formation of the drainage pattern 50, air compressors 60 are provided to circulate compressed air down the substantially vertical well bore 12 and back up through the articulated well bore 30. The circulated air will admix with the drilling fluids in the annulus around the articulated drill string 40 and create bubbles throughout the column of drilling fluid. This has the effective of lightening the hydrostatic pressure of the drilling fluid and reducing the down-hole pressure sufficiently that drilling conditions do not become over balanced. Aeration of the drilling fluid reduces down-hole pressure to approximately 150–200 pounds per square inch (psi). Accordingly, low pressure coal, seams and other subterranean zones can be drilling without substantial loss of drilling fluid and contamination of the zone by the drilling fluid.

Foam, which may be compressed air mixed with water, may also be circulated down through the articulated drill string 40 along with the drilling mud in order to aerate the drilling fluid in the annulus as the articulated well bore 30 is being drilled and, if desired, as the drainage pattern 50 is being drilled. Drilling of the drainage pattern 50 with the use of an air hammer bit or an air-powered down-hole motor will also supply compressed air or foam to the drilling fluid. In this case, the compressed air or foam which is used to power the bit or down-hole motor exits the vicinity of the drill bit 42. However, the larger volume of air which can be circulated down the substantially vertical well bore 12, permits greater aeration of the drilling fluid than generally is possible by air supplied through the articulated drill string 40.

Figure 2:
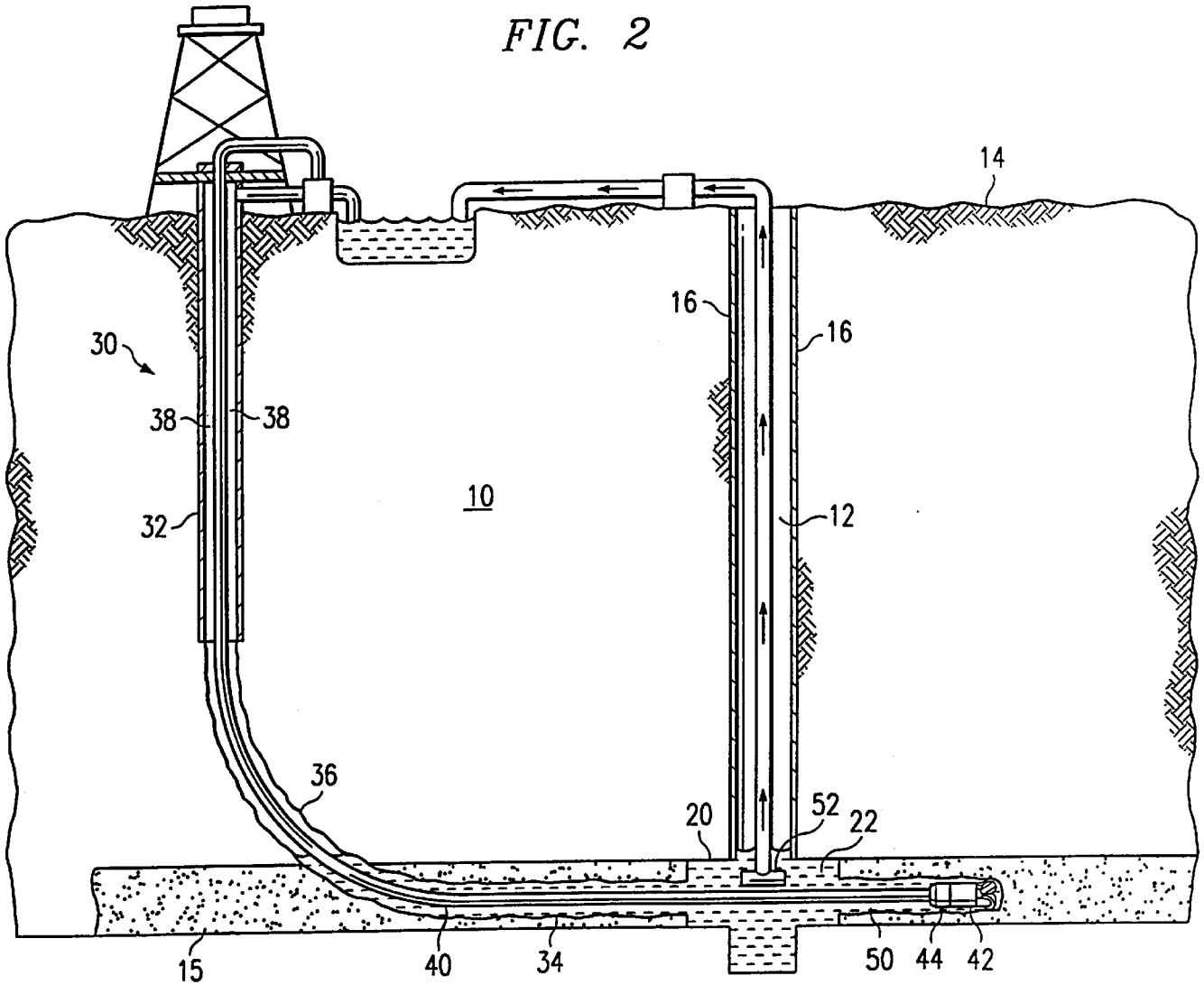
FIG. 2 is a cross-sectional diagram illustrating formation of the horizontal drainage pattern in the subterranean zone through the articulated surface well intersecting the vertical cavity well in accordance with another embodiment of the present invention.

FIG. 2 illustrates method and system for drilling the drainage pattern 50 in the coal seam 15 in accordance with another embodiment of the present invention. In this embodiment, the substantially vertical well bore 12, enlarged diameter cavity 20 and articulated well bore 32 are positioned and formed as previously described in connection with the FIG. 1.

Referring to FIG. 2, after intersection of the enlarged diameter cavity 20 by the articulated well bore 30 a pump 52 is installed in the enlarged diameter cavity to pump drilling fluid and cuttings to the surface 14 through the substantially vertical well bore 12. This eliminates the friction of air and fluid returning up the articulated well bore 30 and reduces down-hole pressure to nearly zero. Accordingly, coal seams and other subterranean zones having ultra low pressures below 150 psi can be accessed from the surface. Additionally, the risk of combining air and methane in the well is eliminated.

Figure 3:
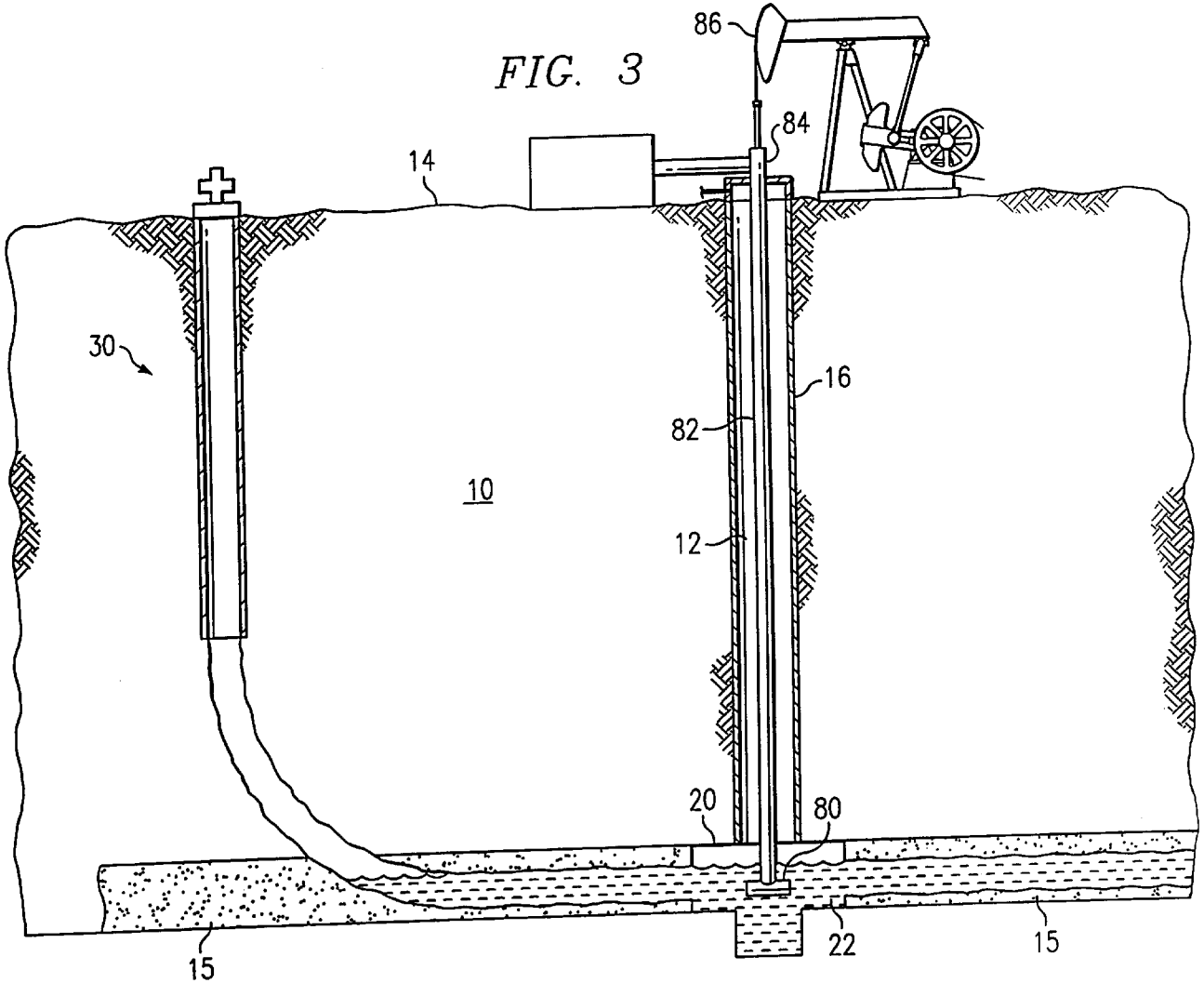
FIG. 3 is a cross-sectional diagram illustrating production of fluids from a horizontal draining pattern in a subterranean zone through a vertical well bore in accordance with one embodiment of the present invention.

FIG. 3 illustrates production of fluids from the horizontal drainage pattern 50 in the coal seam 15 in accordance with one embodiment of the present invention. In this embodiment, after the substantially vertical and articulated well bores 12 and 30 as well as desired drainage pattern 50 have been drilled, the articulated drill string 40 is removed from the articulated well bore 30 and the articulated well bore is capped. For multiple pinnate structure described below, the articulated well 30 may be plugged in the substantially horizontal portion 34. Otherwise, the articulated well may be left unplugged.

Referring to FIG. 3, a down hole pump 80 is disposed in the substantially vertical well bore 12 in the enlarged diameter cavity 22. The enlarged cavity 20 provides a reservoir for accumulated fluids allowing intermittent pumping without adverse effects of a hydrostatic head caused by accumulated fluids in the well bore.

The down hole pump 140 is connected to the surface 14 via a tubing string 82 and may be powered by sucker rods 84 extending down through the well bore 12 of the tubing. The sucker rods 84 are reciprocated by a suitable surface mounted apparatus, such as a powered walking beam 86 to operate the down hole pump 80. The down hole pump 80 is used to remove water and entrained coal fines from the coal seam 15 via the drainage pattern 50. Once the water is removed to the surface, it may be treated for separation of methane which may be dissolved in the water and for removal of entrained fines. After sufficient water has been removed from the coal seam 15, pure coal seam gas may be allowed to flow to the surface 14 through the annulus of the substantially vertical well bore 12 around the tubing string 82 and removed via piping attached to a wellhead apparatus. At the surface, the methane is treated, compressed and pumped through a pipeline for use as a fuel in a conventional manner. The down hole pump 80 may be operated continuously or as needed to remove water drained from the coal seam 15 into the enlarged diameter cavity 22.

FIGS. 4–7 illustrate substantially horizontal drainage patterns 50 for accessing the coal seam 15 or other subterranean zone in accordance with one embodiment of the present invention. In this embodiment, the drainage patterns comprise pinnate patterns that have a central diagonal with generally symmetrically arranged and appropriately spaced laterals extending from each side of the diagonal. The pinnate pattern approximates the pattern of veins in a leaf or the design of a feather in that it has similar, substantially parallel, auxiliary drainage bores arranged in substantially equal and parallel spacing or opposite sides of an axis. The pinnate drainage pattern with its central bore and generally symmetrically arranged and appropriately spaced auxiliary drainage bores on each side provides a uniform pattern for draining fluids from a coal seam or other subterranean formation. As described in more detail below, the pinnate pattern provides substantially uniform coverage of a square, other quadrilateral, or grid area and may be aligned with longwall mining panels for preparing the coal seam 15 for mining operations. It will be understood that other suitable drainage patterns may be used in accordance with the present invention.

The pinnate and other suitable drainage patterns drilled from the surface provide surface access to subterranean formations. The drainage pattern may be used to uniformly remove and/or insert fluids or otherwise manipulate a subterranean deposit. In non coal applications, the drainage pattern may be used initiating in-situ burns, "huff-puff" steam operations for heavy crude oil, and the removal of hydrocarbons from low porosity reservoirs.

Figure 4:
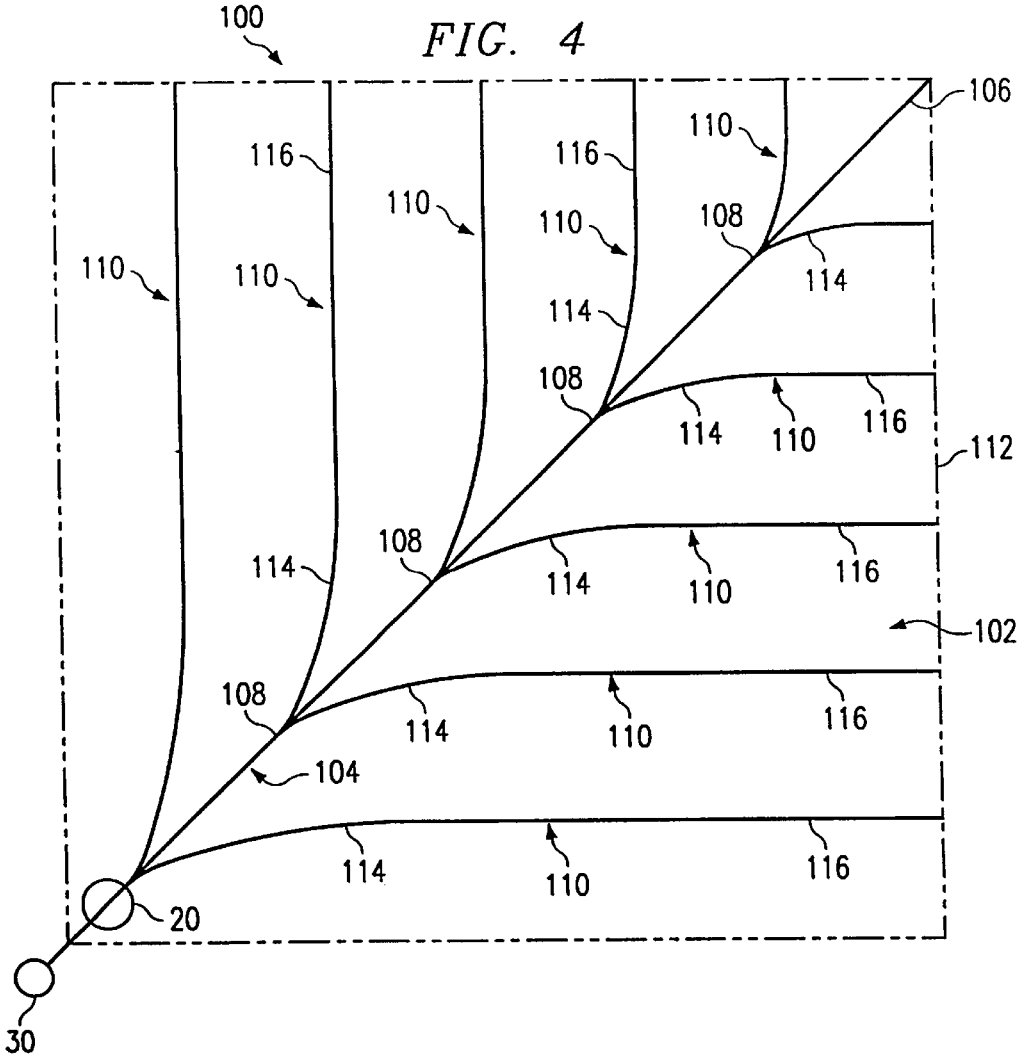
FIG. 4 is a top plan diagram illustrating a pinnate drainage pattern for accessing deposits in a subterranean zone in accordance with one embodiment of the present invention.

FIG. 4 illustrates a pinnate drainage pattern 100 in accordance with one embodiment of the present invention. In this embodiment, the pinnate drainage pattern 100 provides access to a substantially square area 102 of a subterranean zone. A number of the pinnate patterns 60 may be used together to provide uniform access to a large subterranean region.

Referring to FIG. 4, the enlarged diameter cavity 20 defines a first corner of the area 102. The pinnate pattern 100 includes a substantially horizontal main well bore 104 extending diagonally across the area 102 to a distant corner 106 of the area 102. Preferably, the substantially vertical and articulated well bores 12 and 30 are positioned over the area 102 such that the diagonal bore 104 is drilled up the slope of the coal seam 15. This will facilitate collection of water, gas from the area 102. The diagonal bore 104 is drilled using the articulated drill string 40 and extends from the enlarged cavity 20 in alignment with the articulated well bore 30.

A plurality of lateral well bores 110 extend from the opposites sides of diagonal bore 104 to a periphery 112 of the area 102. The lateral bores 122 may mirror each other on opposite sides of the diagonal bore 104 or may be offset from each other along the diagonal bore 104. Each of the lateral bores 110 includes a radius curving portion 114 coming off of the diagonal bore 104 and an elongated portion 116 formed after the curved portion 114 has reached a desired orientation. For uniform coverage of the square area 102, pairs of lateral bores 110 are substantially evenly spaced on each side of the diagonal bore 104 and extend from the diagonal 64 at an angle of approximately 45 degrees. The lateral bores 110 shorten in length based on progression away from the enlarged diameter cavity 20 in order to facilitate drilling of the lateral bores 110.

The pinnate drainage pattern 100 using a single diagonal bore 104 and five pairs of lateral bores 110 may drain a coal seam area of approximately 150 acres in size. Where a smaller area is to be drained, or where the coal seam has a different shape, such as a long, narrow shape or due to surface or subterranean topography, alternate pinnate drainage patterns may be employed by varying the angle of the lateral bores 110 to the diagonal bore 104 and the orientation of the lateral bores 110. Alternatively, lateral bores 120 can be drilled from only one side of the diagonal bore 104 to form a one-half pinnate pattern.

The diagonal bore 104 and the lateral bores 110 are formed by drilling through the enlarged diameter cavity 20 using the articulated drill string 40 and appropriate horizontal drilling apparatus. During this operation, gamma ray logging tools and conventional measurement while drilling technologies may be employed to control the direction and orientation of the drill bit so as to retain the drainage pattern within the confines of the coal seam 15 and to maintain proper spacing and orientation of the diagonal and lateral bores 104 and 110.

In a particular embodiment, the diagonal bore 104 is drilled with an incline at each of a plurality of lateral kick-off points 108. After the diagonal 104 is complete, the articulated drill string 40 is backed up to each successive lateral point 108 from which a lateral bore 110 is drilled on each side of the diagonal 104. It will be understood that the pinnate drainage pattern 100 may be otherwise suitably formed in accordance with the present invention.

Figure 5:
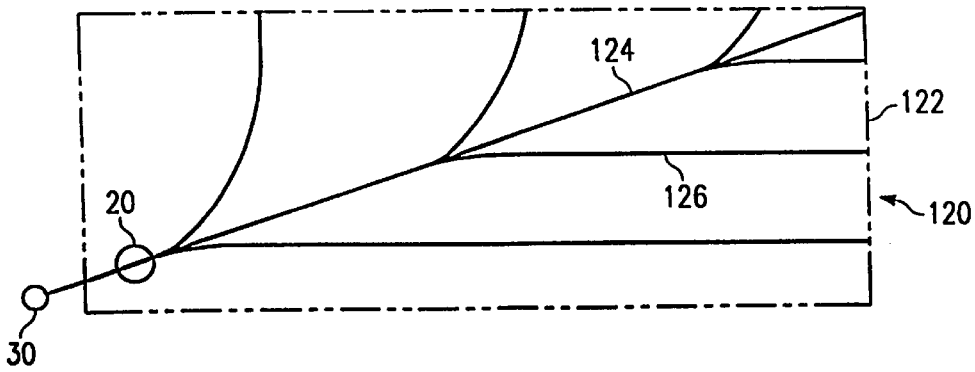
FIG. 5 is a top plan diagram illustrating a pinnate drainage pattern for accessing deposits in a subterranean zone in accordance with another embodiment of the present invention.

FIG. 5 illustrates a pinnate drainage pattern 120 in accordance with another embodiment of the present invention. In this embodiment, the pinnate drainage pattern 120 drains a substantially rectangular area 122 of the coal seam 15. The pinnate drainage pattern 120 includes a main diagonal bore 124 and a plurality of lateral bores 126 that are formed as described in connection with diagonal and lateral bores 104 and 110 of FIG. 4. For the substantially rectangular area 122, however, the lateral bores 126 on a first side of the diagonal 124 include a shallow angle while the lateral bores 126 on the opposite side of the diagonal 124 include a steeper angle to together provide uniform coverage of the area 12.

Figure 6:
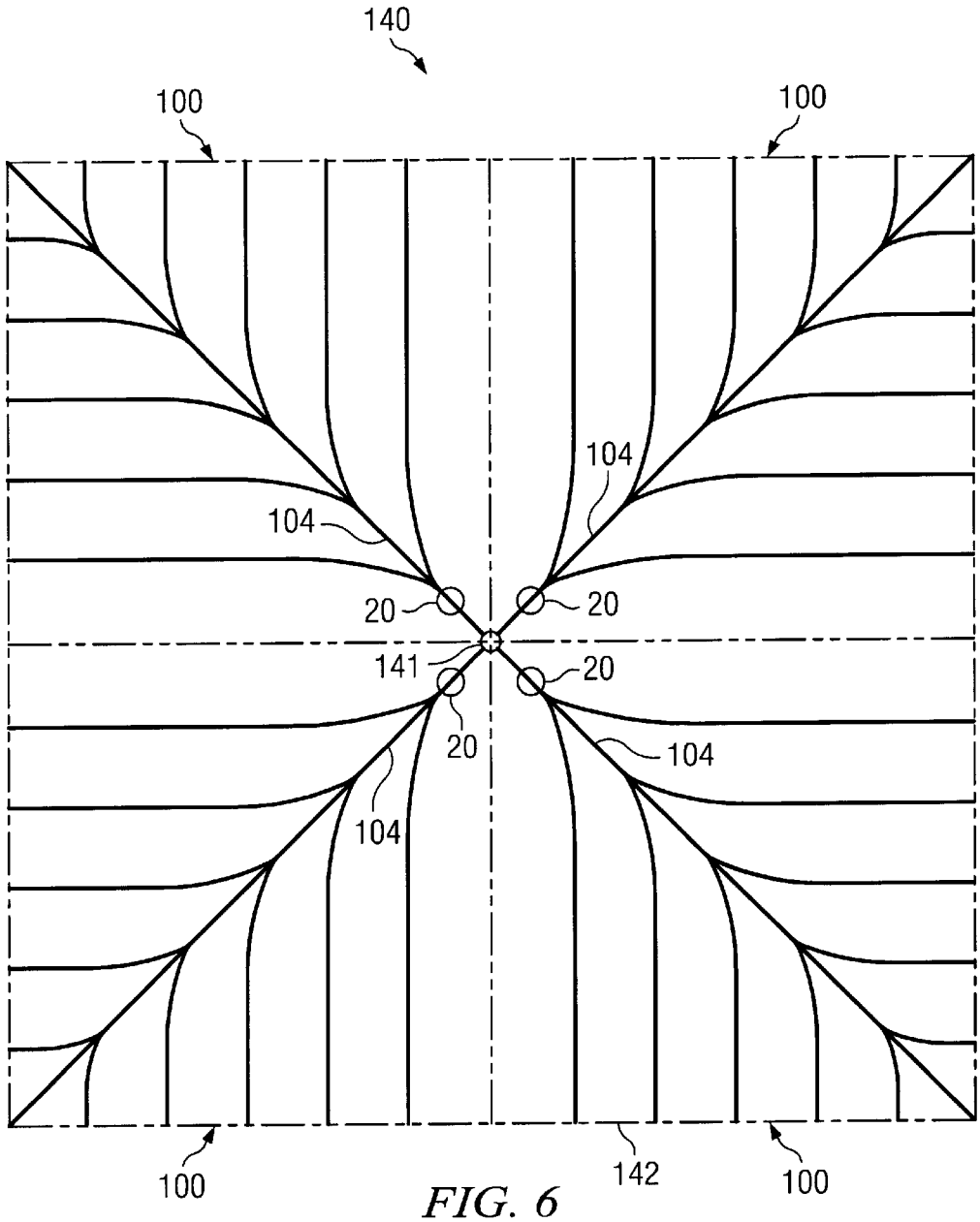
FIG. 6 is a top plan diagram illustrating a quadrilateral pinnate drainage pattern for accessing deposits in a subterranean zone in accordance with still another embodiment of the present invention.

FIG. 6 illustrates a quadrilateral pinnate drainage pattern 140 in accordance with another embodiment of the present invention. The quadrilateral drainage pattern 140 includes four discrete pinnate drainage patterns 100 each draining a quadrant of a region 142 covered by the pinnate drainage pattern 140.

Each of the pinnate drainage patterns 100 includes a diagonal well bore 104 and a plurality of lateral well bores 110 extending from the diagonal well bore 104. In the quadrilateral embodiment, each of the diagonal and lateral bores 104 and 110 are drilled from a common articulated well bore 141. This allows tighter spacing of the surface production equipment, wider coverage of a drainage pattern and reduces drilling equipment and operations.

Figure 7:
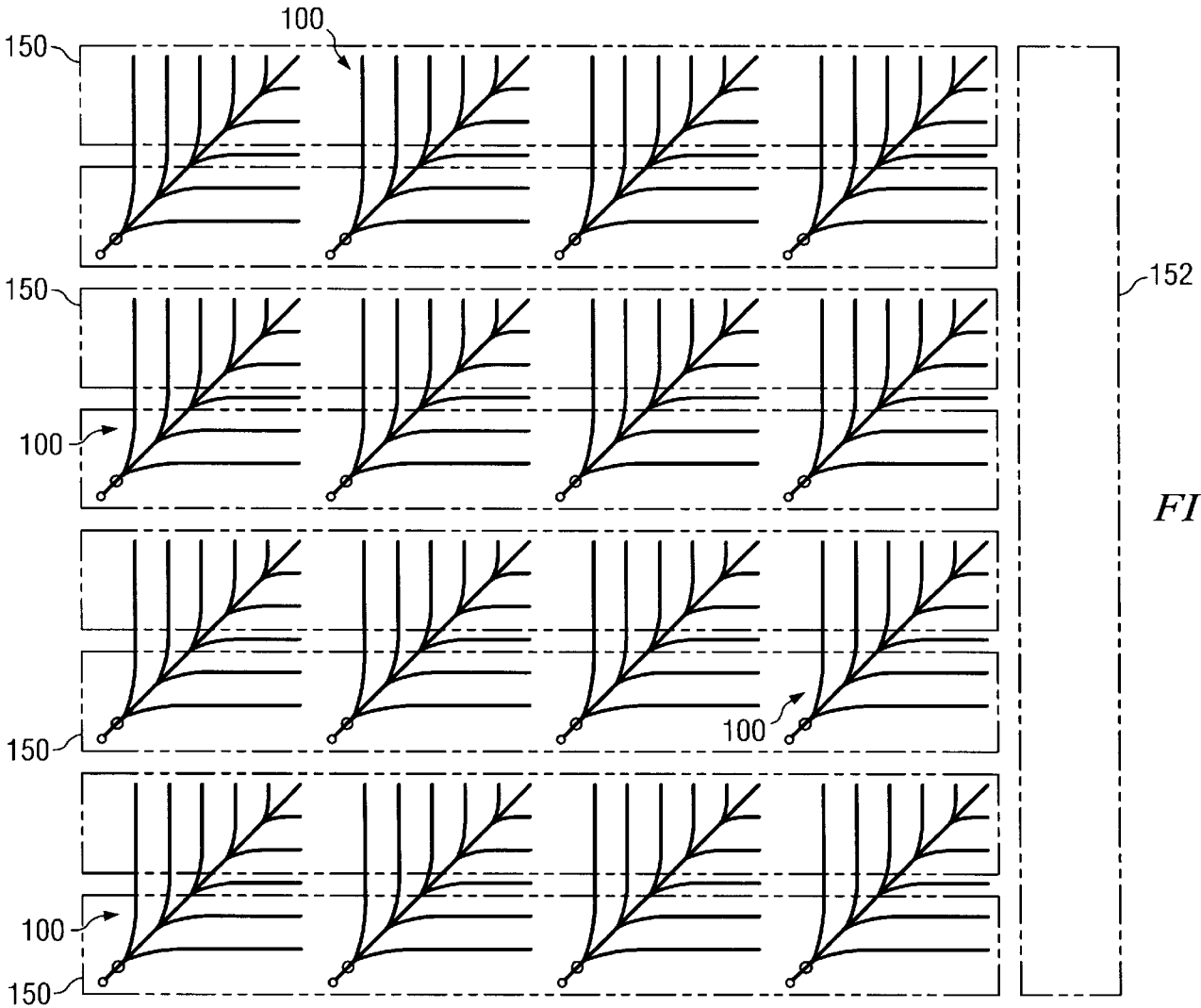
FIG. 7 is a top plan diagram illustrating the alignment of pinnate drainage patterns within panels of a coal seam for degasifying and preparing the coal seam for mining operations in accordance with one embodiment of the present invention.

FIG. 7 illustrates the alignment of pinnate drainage patterns 100 with subterranean structures of a coal seam for degasifying and preparing the coal seam for mining operations in accordance with one embodiment of the present invention. In this embodiment, the coal seam 15 is mined using a longwall process. It will be understood that the present invention can be used to degassify coal seams for other types of mining operations.

Referring to FIG. 7, coal panels 150 extend longitudinally from a longwall 152. In accordance with longwall mining practices, each panel 150 is subsequently mined from a distant end toward the longwall 152 and the mine roof allowed to cave and fracture into the opening behind the mining process. Prior to mining of the panels 150, the pinnate drainage patterns 100 are drilled into the panels 150 from the surface to degasify the panels 150 well ahead of mining operations. Each of the pinnate drainage patterns 100 is aligned with the longwall 152 and panel 150 grid and covers portions of one or more panels 150. In this way, a region of a mine can be degasified from the surface based on subterranean structures and constraints.

Figure 8:
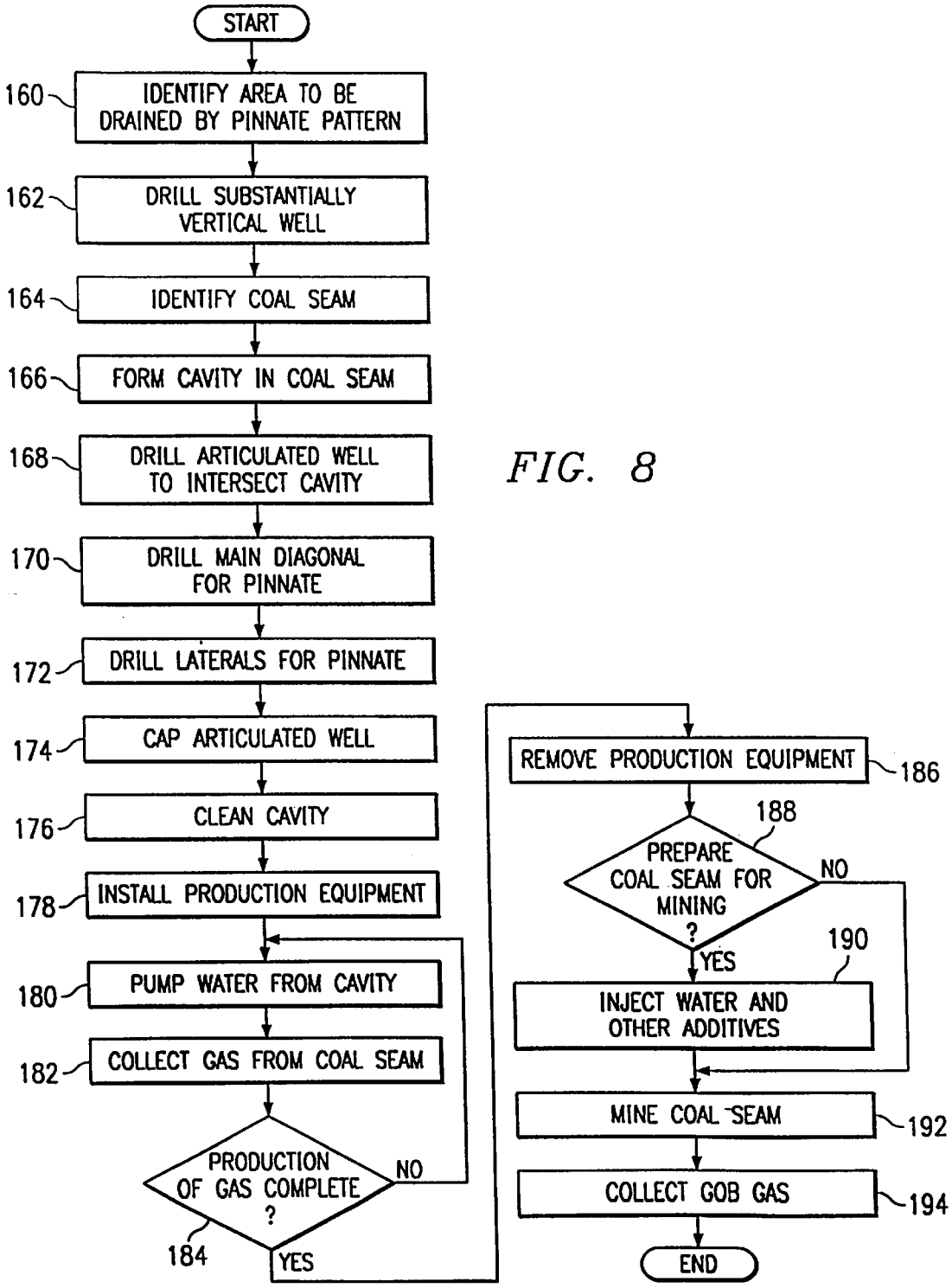
FIG. 8 is a flow diagram illustrating a method for preparing a coal seam for mining operations in accordance with one embodiment of the present invention.

FIG. 8 is a flow diagram illustrating a method for preparing the coal seam for mining operations in accordance with one embodiment of the present invention. In this embodiment, the method begins at step 160 in which areas to be drained and drainage patterns 50 for the areas are identified. Preferably, the areas are aligned with the grid of a mining plan for the region. Pinnate structures 100, 120 and 140 may be used to provide optimized coverage for the region. It will be understood that other suitable patterns may be used to degasify the coal seam 15.

Proceeding to step 162, the substantially vertical well 12 is drilled from the surface 14 through the coal seam 15. Next, at step 164, down hole logging equipment is utilized to exactly identify the location of the coal seam in the substantially well bore 12. At step 164, the enlarged diameter cavity 22 is formed in the substantially vertical well bore 12 at the location of the coal seam 15. As previously discussed, the enlarged diameter cavity 20 may be formed by under reaming and other conventional techniques.

Next, at step 166, the articulated well bore 30 is drilled to intersect the enlarged diameter cavity 22. At step 168, the main diagonal bore 104 for the pinnate drainage pattern 100 is drilled through the articulated well bore 30 into the coal seam 15. After formation of the main diagonal 104, lateral bores 110 for the pinnate drainage pattern 100 are drilled at step 170. As previously described, lateral kick-off points may be formed in the diagonal bore 104 during its formation to facilitate drilling of the lateral bores 110.

At step 172, the articulated well bore 30 is capped. Next, at step 174, the enlarged diagonal cavity 22 is cleaned in preparation for installation of downhole production equipment. The enlarged diameter cavity 22 may be cleaned by pumping compressed air down the substantially vertical well bore 12 or other suitable techniques. At step 176, production equipment is installed in the substantially vertical well bore 12. The production equipment includes a sucker rod pump extending down into the cavity 22 for removing water from the coal seam 15. The removal of water will drop the pressure of the coal seam and allow methane gas to diffuse and be produced up the annulus of the substantially vertical well bore 12.

Proceeding to step 178, water that drains from the drainage pattern 100 into the cavity 22 is pumped to the surface with the rod pumping unit. Water may be continuously or intermittently be pumped as needed to remove it from the cavity 22. At step 180, methane gas diffused from the coal seam 15 is continuously collected at the surface 14. Next, at decisional step 182 it is determined whether the production of gas from the coal seam 15 is complete. In one embodiment, the production of gas may be complete after the cost of the collecting the gas exceeds the revenue generated by the well. In another embodiment, gas may continue to be produced from the well until a remaining level of gas in the coal seam 15 is below required levels for mining operations. If production of the gas is not complete, the No branch of decisional step 182 returns to steps 178 and 180 in which water and gas continue to be removed from the coal seam 15. Upon completion of production, the Yes branch of decisional step 182 leads to step 184 in which the production equipment is removed.

Next, at decisional step 186, it is determined whether the coal seam 15 is to be further prepared for mining operations. If the coal seam 15 is to be further prepared for mining operations, the Yes branch of decisional step 186 leads to step 188 in which water and other additives may be injected back into the coal seam 15 to rehydrate the coal seam in order to minimize dust, to improve the efficiency of mining, and to improve the mined product.

Step 188 and the No branch of decisional step 186 lead to step 190 in which the coal seam 15 is mined. The removal of the coal from the seam causes the mined roof to cave and fracture into the opening behind the mining process. The collapsed roof creates gob gas which may be collected at step 192 through the substantially vertical well bore 12. Accordingly, additional drilling operations are not required to recover gob gas from a mined coal seam. Step 192 leads to the end of the process by which a coal seam is efficiently degasified from the surface. The method provides a symbiotic relationship with the mine to remove unwanted gas prior to mining and to rehydrate the coal prior to the mining process.

A well cavity pump comprises a well bore portion and a cavity positioning device. The well bore portion comprises an inlet for drawing and transferring well fluid contained within cavity 20 to a surface of vertical well bore 12.

In this embodiment, the cavity positioning device is rotatably coupled to the well bore portion to provide rotational movement of the cavity positioning device relative to the well bore portion. For example, a pin, shaft, or other suitable method or device (not explicitly shown) may be used to rotatably couple the cavity position device to the well bore portion to provide pivotal movement of the cavity positioning device about an axis relative to the well bore portion. Thus, the cavity positioning device may be coupled to the well bore portion between two ends of the cavity positioning device such that both ends may be rotatably manipulated relative to the well bore portion.

The cavity positioning device also comprises a counter balance portion to control a position of the ends relative to the well bore portion in a generally unsupported condition. For example, the cavity positioning device is generally cantilevered about the axis relative to the well bore portion. The counter balance portion is disposed along the cavity positioning device between the axis and the end such that a weight or mass of the counter balance portion counter balances the cavity positioning device during deployment and withdrawal of the well cavity pump relative to vertical well bore 12 and cavity 20.

In operation, the cavity positioning device is deployed into vertical well bore 12 having the end and the counter balance portion positioned in a generally retracted condition, thereby disposing the end and the counter balance portion adjacent the well bore portion. As the well cavity pump travels downwardly within vertical well bore 12, a length of the cavity positioning device generally prevents rotational movement of the cavity positioning device relative to the well bore portion. For example, the mass of the counter balance portion may cause the counter balance portion and the end to be generally supported by contact with a vertical wall of vertical well bore 12 as the well cavity pump travels downwardly within vertical well bore 12.

As well cavity pump travels downwardly within vertical well bore 12, the counter balance portion causes rotational or pivotal movement of the cavity positioning device relative to the well bore portion as the cavity positioning device transitions from vertical well bore 12 to cavity 20. For example, as the cavity positioning device transitions from vertical well bore 12 to cavity 20, the counter balance portion and the end become generally unsupported by the vertical wall of vertical well bore 12. As the counter balance portion and the end become generally unsupported, the counter balance portion automatically causes rotational movement of the cavity positioning device relative to the well bore portion. For example, the counter balance portion generally causes the end to rotate or extend outwardly relative to vertical well bore 12. Additionally, the end of the cavity positioning device extends or rotates outwardly relative to vertical well bore 12.

The length of the cavity positioning device is configured such that the ends of the cavity positioning device become generally unsupported by vertical well bore 12 as the cavity positioning device transitions from vertical well bore 12 into cavity 20, thereby allowing the counter balance portion to cause rotational movement of the end outwardly relative to the well bore portion and beyond an annulus portion of sump 22. Thus, in operation, as the cavity positioning device transitions from vertical well bore 12 to cavity 20, the counter balance portion causes the end to rotate or extend outwardly such that continued downward travel of the well cavity pump results in contact of the end with a horizontal wall of cavity 20.

As downwardly travel of the well cavity pump continues, the contact of the end with the horizontal wall of cavity 20 causes further rotational movement of the cavity positioning device relative to the well bore portion. For example, contact between the end and the horizontal wall combined with downward travel of the well cavity pump causes the end to extend or rotate outwardly relative to vertical well bore 12 until the counter balance portion contacts a horizontal wall of cavity 20. Once the counter balance portion and the end of the cavity positioning device become generally supported by the horizontal walls of cavity 20, continued downward travel of the well cavity pump is substantially prevented, thereby positioning the inlet at a predefined location within cavity 20.

Thus, the inlet may be located at various positions along the well bore portion such that the inlet is disposed at the predefined location within cavity 20 as the cavity positioning device bottoms out within cavity 20. Therefore, the inlet may be accurately positioned within cavity 20 to substantially prevent drawing in debris or other material disposed within sump or rat hole 22 and to prevent gas interference caused by placement of the inlet 20 in the narrow well bore. Additionally, the inlet may be positioned within cavity 20 to maximize fluid withdrawal from cavity 20.

In reverse operation, upward travel of the well cavity pump generally results in releasing contact between the counter balance portion and the end with the horizontal walls, respectively. As the cavity positioning device becomes generally unsupported within cavity 20, the mass of the cavity positioning device disposed between the end and the axis generally causes the cavity positioning device to rotate. Additionally, the counter balance portion cooperates with the mass of the cavity positioning device disposed between the end and the axis to generally align the cavity positioning device with vertical well bore 12. Thus, the cavity positioning device automatically becomes aligned with vertical well bore 12 as the well cavity pump is withdrawn from cavity 20. Additional upward travel of the well cavity pump then may be used to remove the cavity positioning device from cavity 20 and vertical well bore 12.

Therefore, the present invention provides greater reliability than prior systems and methods by positively locating the inlet of the well cavity pump at a predefined location within cavity 20. Additionally, the well cavity pump may be efficiently removed from cavity 20 without requiring additional unlocking or alignment tools to facilitate the withdrawal of the well cavity pump from cavity 20 and vertical well bore 12.

Although the present invention has been described with several embodiments, various changes and modifications may be suggested to one skilled in the art. It is intended that the present invention encompass such changes and modifications as fall within the scope of the appended claims.

What is claimed is:

1. A system for surface production of gas from a subterranean zone, comprising:

a first well bore extending from the surface into the earth;

a second well bore extending from the surface into the earth;

the first and second well bores coupled to each other at a junction in the earth; and a drainage well bore pattern comprising a plurality of lateral well bores, the drainage well bore pattern coupled to the junction and operable to conduct fluids from a subterranean zone to the junction; and wherein gas may be produced from the subterranean zone to the surface through the first well bore.

2. A system for accessing a subterranean zone from the surface, comprising:

a first well bore extending from the surface to the subterranean zone;

a second well bore extending from the surface to the subterranean zone, the second well bore intersecting the first well bore at a junction proximate the subterranean zone; and a well bore pattern connected to the junction and operable to drain fluid from a region of the subterranean zone to the junction.

3. A method for accessing a subterranean zone from the surface, comprising:

forming a first well bore extending from the surface to the subterranean zone;

forming a second well bore extending from the surface to the subterranean zone, the second well bore intersecting the first well bore at a junction proximate the subterranean zone; and forming a well bore pattern connected to the junction and providing drainage of fluids from the subterranean zone to the junction for production to the surface.

* * * * *